US008550123B2

(12) United States Patent
Laukamp et al.

(10) Patent No.: US 8,550,123 B2
(45) Date of Patent: Oct. 8, 2013

(54) DEVICE FOR TRANSFERRING A BAND-SHAPED WEFT MATERIAL

(75) Inventors: Thomas Laukamp, Lindau (DE); Herbert Mueller, Pineville, NC (US)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 2 days.

(21) Appl. No.: 13/387,892

(22) PCT Filed: Jul. 6, 2010

(86) PCT No.: PCT/DE2010/000776

§ 371 (c)(1),
(2), (4) Date: Jan. 30, 2012

(87) PCT Pub. No.: WO2011/015173

PCT Pub. Date: Feb. 10, 2011

(65) Prior Publication Data

US 2012/0125476 A1 May 24, 2012

(30) Foreign Application Priority Data

Aug. 7, 2009 (DE) ..... 10 2009 036 589

(51) Int. Cl.
*D03D 47/23* (2006.01)
*D03D 47/27* (2006.01)

(52) U.S. Cl.
USPC ..... 139/420 A; 139/116.1; 139/383 R; 139/420 R; 139/426 R

(58) Field of Classification Search
None
See application file for complete search history.

(56) References Cited

U.S. PATENT DOCUMENTS

| | | | | |
|---|---|---|---|---|
| 3,665,975 | A | 5/1972 | Kokkinis | |
| 3,717,182 | A | 2/1973 | Sparling | |
| 3,927,699 | A * | 12/1975 | Volpe | 139/448 |
| 3,998,251 | A | 12/1976 | Hadam | |
| 4,040,454 | A | 8/1977 | Genini | |
| 4,188,980 | A | 2/1980 | Muller | |
| 4,540,028 | A | 9/1985 | Gehring et al. | |
| 4,558,722 | A | 12/1985 | Gehring et al. | |
| 4,699,183 | A | 10/1987 | Menzel | |
| 4,785,856 | A | 11/1988 | Gehring et al. | |

(Continued)

FOREIGN PATENT DOCUMENTS

| | | |
|---|---|---|
| DE | 528 345 | 6/1931 |
| DE | 553 886 | 7/1932 |

(Continued)

OTHER PUBLICATIONS

PCT Examiner Daniela Iamandi, International Search Report of the International Searching Authority for International Application PCT/DE2010/000776, mailed Sep. 22, 2010, 3 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

For transferring a preferably band-shaped weft material from a feed unit to an insertion element of a weaving machine, a free end of the weft material is clamped in a clamping device, the free end is transferred to the insertion element, and then the clamping device is opened to release the weft material, which is then inserted by the insertion element. The clamping device is conveyed by a drive essentially in the direction of motion of the insertion element between at least two different operating positions.

33 Claims, 3 Drawing Sheets

(56) References Cited

U.S. PATENT DOCUMENTS

| | | | | |
|---|---|---|---|---|
| 4,905,741 | A | 3/1990 | Wahhoud et al. | |
| 4,919,171 | A | 4/1990 | Dornier | |
| 4,922,970 | A | 5/1990 | Gehring et al. | |
| 4,958,664 | A | 9/1990 | Oppl et al. | |
| 5,088,525 | A | 2/1992 | Zimmermann | |
| 5,183,084 | A | 2/1993 | Moeneclaey | |
| 5,303,747 | A | 4/1994 | Arndt et al. | |
| 5,455,107 | A * | 10/1995 | Homma et al. | 442/60 |
| 5,566,725 | A | 10/1996 | Jaeger | |
| 5,664,609 | A | 9/1997 | Herrlein et al. | |
| 6,026,865 | A * | 2/2000 | Krumm et al. | 139/453 |
| 6,382,262 | B1 | 5/2002 | Herzig | |
| 7,992,596 | B2 * | 8/2011 | Khokar | 139/420 R |
| 8,129,294 | B2 * | 3/2012 | Khokar | 442/186 |
| 2006/0169347 | A1 * | 8/2006 | Wahhoud | 139/383 R |
| 2008/0257443 | A1 * | 10/2008 | Khokar | 139/443 |
| 2009/0007981 | A1 * | 1/2009 | Khokar | 139/383 A |
| 2009/0065090 | A1 * | 3/2009 | Bachofen et al. | 139/448 |
| 2012/0125475 | A1 * | 5/2012 | Oppl | 139/448 |

FOREIGN PATENT DOCUMENTS

| | | |
|---|---|---|
| DE | 645 465 | 5/1937 |
| DE | 25 17 011 | 5/1976 |
| DE | 25 41 990 | 8/1976 |
| DE | 299 08 543 | 8/1999 |
| EP | 0 240 075 | 10/1987 |
| EP | 0 863 237 | 9/1998 |
| EP | 2 037 023 | 3/2009 |
| GB | 2 072 718 | 10/1981 |
| JP | 55-051845 | 4/1980 |
| WO | WO 06/075961 | 7/2006 |
| WO | WO 08/009332 | 1/2008 |

OTHER PUBLICATIONS

PCT Examiner Agnès Wittmann-Regis, PCT International Preliminary Report on Patentability including English Translation of PCT Written Opinion of the International Searching Authority for International Application PCT/DE2010/000776, issued Feb. 7, 2012, 8 pages, International Bureau of WIPO, Geneva, Switzerland.

English translation of Japanese Office Action issued Apr. 23, 2013 in Japanese Patent Application 2012-523198.

* cited by examiner

DEVICE FOR TRANSFERRING A BAND-SHAPED WEFT MATERIAL

FIELD OF THE INVENTION

The present invention relates to a device and a method for transferring a band-shaped weft material from a feed unit to an insertion element of a weaving machine. The device includes a clamping device for clamping a free end of the weft material.

BACKGROUND INFORMATION

In the state-of-the-art, a variety of devices for weaving machines have become known, for transferring a weft material to an insertion element, for example, a gripper of a gripper weaving machine.

In the WO 2008/009332 A1, for carrying out weft selection, needle-shaped rods are provided with eyelets through which respectively the weft thread is guided and which can be brought from a resting position to an active position depending on which weft thread is selected. The selected weft thread is then as brought by a movable feeder into a transfer position for the gripper.

The EP 0 240 075 B1 describes a device with a weft thread selection device, which is equipped with a movable weft thread clamp for each weft thread. By a pivoting or swiveling motion of the weft thread clamp in a plane perpendicular to the feed direction or to the weft insertion direction, the weft thread is respectively brought into a transfer position for the gripper. The weft threads are thus deflected several times in different directions and then finally laid before the insertion element so that they cross it at an angle and thereby can be inserted into the clamping device of the insertion element. These kinds of devices are not suitable for band-shaped weft material because the deflections would result in damage to the weft bands.

The U.S. Pat. No. 5,455,107 shows a device for delivering or feeding a weft material, which is also meant to be suitable for band-shaped weft materials. Here, the free end of the weft material is clamped into a clamp which is fixedly or rigidly attached to the weaving machine. To deliver or feed the weft material to the insertion element, a feeder is provided, which is movable in the warp direction along the edge of the fabric. The weft material is laid before the insertion element at an angle, just as for the above described devices, so that damage may occur, particularly when using weft bands containing reinforcing fibers.

The WO 2006/075961 A1 describes a device for feeding a band-shaped weft material in which the weft material is fed by a feed unit with a pair of rollers into an insertion channel, where it is clamped by a clamping device. To feed the weft material into the insertion element, the clamping device is opened and the weft material is positioned by means of the feed unit in the direction of the gripper, which grasps the band-shaped weft material directly at its front end. The weft material can thus be delivered or fed to the gripper essentially without deflection. Due to the relative movement of the band-shaped weft material between the rollers, the weft material may nonetheless be damaged.

The DE 528 345 as well as the DE 5 53 886 show devices for transferring a weft thread to a gripper weaving shuttle, which, however, require large structural space, and which are mechanically driven with complex means.

SUMMARY OF THE INVENTION

The objective of the present invention is thus to create a device for delivering or feeding a weft material that is also suitable for a band-shaped weft material while reducing the risk of damaging the band-shaped weft material. Furthermore, a corresponding method for delivering or feeding a weft material shall be suggested.

The objective is fulfilled by the characteristics of the independent claims.

A device for transferring a band-shaped weft material from a feed unit to an insertion element of a weaving machine comprises a clamping device for clamping the free end of the weft material.

In this regard, the feed unit can be a driven spool, which unwinds the weft material required for a weft insertion, or a feeder can be provided as a feed unit, which respectively unwinds from the spool the amount of band material required for a weft insertion. The feed unit can also be formed by a reservoir, from which the weft material runs into the device for transferring the weft material.

It is provided that the clamping device is conveyable essentially in the direction of motion of the insertion element between at least two different operating positions and the device includes a drive for conveying the clamping device. Due to the motion of the clamping device solely in the weft direction or respectively in the motion direction of the insertion element, the band assumes a mostly stretched, twist-free and deflection-free course or path from the feed unit to its transfer to the insertion element. Due to this, shearing forces that could damage the band do not arise. No deflection takes place in the direction of the width extension of the band-shaped weft material. If the clamping device is conveyable along the extension of the insertion element's line of motion, then the device can be used to perform different feed movements without any deflection occurring in the direction of the width extension of a band-shaped weft material. Thus, band materials with reinforcing fibers can also be fed without being damaged. In a corresponding method for transferring a band-shaped weft material, a free end of the weft material is clamped into a clamping device. The free end is transferred to the insertion element and then the clamping device opens and the weft material is inserted. The clamping device is moved by means of a drive essentially in the direction of motion of the insertion element between at least two different operating positions.

The clamping device can, for instance, be moved by means of a linear drive between a transfer position and a feed position on the line of motion of the insertion element, as will be described in more detail below. The clamping device can, however, also be moved by means of a rotational movement. Since only a small portion of the complete rotation is used in this case, the movement of the clamping device is nonetheless essentially in the direction of motion of the insertion element. The clamping device is conveyable by means of a pivot or swivel unit, which includes at least one pivot or swivel arm and is drivable by the drive.

In accordance with the invention, the swivel unit includes two parallel swivel arms, which are connected by a coupling element. The clamping unit is arranged on the coupling element and thus is held essentially in the weft direction or rather in a plane parallel to the weft direction, so that the weft material to be fed always assumes a substantially stretched, deflection-free course or path.

In a first embodiment of the invention, the clamping device is conveyable between a transfer position on the extension of the line of motion of the insertion element and a parked position outside of the line of motion of the insertion element. In this regard, in the transfer position, the band-shaped weft material can be delivered or fed to the insertion element by opening and closing of the clamping device, while in the parked position, an exchange of the supply package or feed spool of the weft material and other maintenance tasks can be performed.

An especially advantageous development of the invention provides that the device includes a second swivel unit with a second clamping device for feeding a second weft material, and the clamping devices are selectively conveyable between their individual parked positions and a shared or common transfer position. This makes it possible to feed two different weft materials in a freely selectable manner to create a certain pattern or to make it possible to change a supply package without stopping the weaving machine. In order to feed a second weft material to the insertion element, advantageously after the insertion and cutting of a first weft material, the closed first clamping device is moved into its parked position and the closed second clamping device is moved out of its parked position and into the shared transfer position. This allows the weft material to be fed to the insertion element at a defined transfer position, even after a change of the weft material to be fed.

Another development of the invention provides that the clamping device is conveyable from the transfer position in the line of motion of the insertion element into a feed or delivery position in the line of motion of the insertion element. Thus, in the feed position, the weft material can be actively fed into the opened clamp of the insertion element. Subsequently, the clamping device is opened and the weft material is inserted.

Another advantageous development provides that, during or after the insertion of the weft material, the clamping device is moved from the transfer position or the feed position to a cutting position in the line of motion of the insertion element, and after completion of the weft insertion, the inserted weft material is cut off. This makes it possible to reduce to a minimum, the length of the protruding free end which is transported by the gripper to the other side of the fabric and there results in waste material.

In this regard, it is particularly advantageous if the location of the feed position and/or of the cutting position can be freely set or adjusted. The length of the protruding free end can thus be set so that the free end, on the one hand, can still just be grasped by the gripper and, on the other hand, barely protrudes past the opposite edge of the fabric after the weft insertion. The amount of the weft material arising as waste can thus be further reduced.

It is furthermore particularly advantageous if the drive is formed by an independent electric motor drive, e.g. a servomotor. This allows for the free selection of the weft material to be inserted and the transfer of the clamping device into the different positions independent of the drive of the weaving machine. It is, however, also possible to drive the clamping device or the swivel unit using the weaving machine's main drive.

Furthermore it is advantageous if the swivel unit with the clamping device can be driven in reverse to apply a tension to the weft material. Thus, by means of the drive, the inserted weft material can be put under tension when the clamping device is closed. The inventive method is characterized in that after the insertion of the weft material, the clamping device for clamping the inserted weft material is closed and the weft material is put under tension. The weft material is thus kept under tension while it is brought to the binding or interlacing point so that damage to the weft material is avoided. Likewise, the weft material can be kept under tension for cutting after the weft insertion.

According to a particularly advantageous embodiment of the invention, the clamping device is embodied as a parallel gripper with two movable clamping jaws. Because both of the clamping jaws move away from the weft material when the clamping device is opened, the weft material runs or extends essentially freely between the feed unit and the insertion element during the weft insertion. Thus a free weft insertion is possible, in which the weft material is subjected to only a few friction or rubbing points. This also contributes to avoiding damage of the weft material. Preferably, the clamping device is activated pneumatically because compressed air is already available on the machine anyway.

Another advantageous development provides that the clamping jaws in the area of the clamping surfaces comprise a semi-circular cross-section or a cross-section curved in some other way in the direction of the width of the weft material. The weft material is thus slightly deformed in regards to its transverse direction by the clamp shape so that during the transfer, the freely protruding end is stiffened by the clamping device's clamp. Devices of the type in accordance with the invention especially offer advantages in the processing of band-shaped weft material in the width range from 1 mm to 50 mm.

Furthermore it is advantageous if the shape of the clamping device is adapted to the shape of the insertion element. The insertion element can thus be moved very close to the clamping device for transferring the weft material.

Furthermore it is advantageous if the device includes a sensor, which detects the presence of a weft material and/or the position of the free end of the weft material. This kind of sensor can be installed for example in the area of the transfer position to make threading the weft material into the clamping device easier for an operator during an exchange of the supply package. Preferably, after a preset position of the end of the weft material has been reached, the clamping device is automatically closed, so that the device is again available for the weft insertion. Similarly, by means of a sensor, the running-out of a weft material can be registered and an error notification can be generated, the switch to the other weft material can be performed, or the weaving machine can be stopped.

In addition, it is advantageous if the device includes guide means, preferably guide bolts, for the weft material. In particular during the motion of the clamping device, the weft material can be constantly held in a stretched condition within the device. Due to the arrangement of the guide bolts and the clamps, the weft material moves essentially freely, meaning without or with very little deflection between the feed unit and the insertion element.

Furthermore it is advantageous if the weaving machine is equipped with a rotating shear or thread cutter, which is conveyable in the warp direction, as a cutting device for the weft material. Due to the embodiment of the cutting device as a rotating shear, a jamming of the weft material in the cutting device can be avoided, making it especially suitable for band-shaped weft materials. Due to the motion of the rotating shear in the warp direction during the cutting process, band-shaped materials can be cut particularly surely or reliably. Preferably, the cutting device comprises a fixed counter-blade or anvil-blade that is mounted on the weaving machine.

According to an advantageous development of the invention, the rotating shear can be driven by the main drive of the weaving machine via a cam disk transmission or gearbox in order to be moved in the warp direction. It can, however, also be advantageous if the rotating shear is moved by a servomotor because the timing and duration of the cutting process can be freely adjusted or set independently of the weaving machine's drive.

BRIEF DESCRIPTION OF THE DRAWINGS

Further advantages of the invention are described in connection with the following example embodiments. It is shown by.

DETAILED DESCRIPTION OF EXAMPLE EMBODIMENTS OF THE INVENTION

Figure 1:
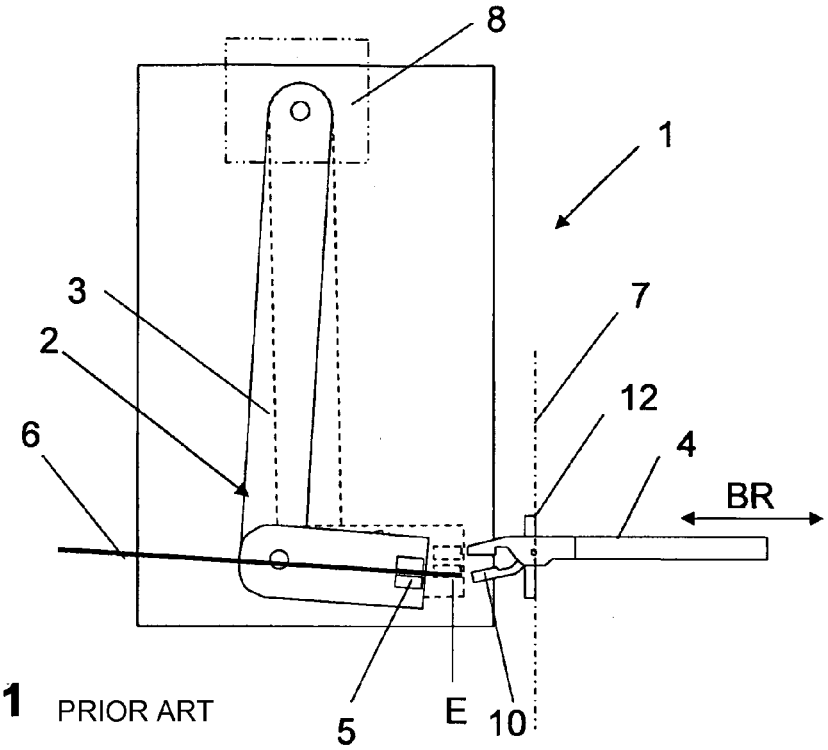
Fig. 1 PRIOR ART
FIG. 1 device in accordance with the state-of-the-art with one swivel unit with one swivel arm in a conceptual illustration, FIG. 2 a first embodiment of the invention with one swivel unit with two swivel arms in the transfer position, FIG. 3 the device of FIG. 2 in the transfer position during the weft insertion, FIG. 4 the device of FIG. 2 in the cutting position, FIG. 5 a further embodiment of the invention with two swivel units, and FIG. 6 a schematic illustration of a clamping device.

FIG. 1 shows a device 1 in accordance with the state-of-the-art for transferring band-shaped weft material 6 with a swivel unit 2 with only one swivel arm 3. The device 1 transfers the weft material 6 from a feed unit, not shown here, to the insertion element 4 of a weaving machine. The feed unit can be formed by a feed or supply package or bobbin, a reservoir or thread store, or a thread pre-spooling device or feeder, which unwinds the respective required length of the weft material from the spool and makes it available. The insertion element 4 as presented here is embodied as a gripper of a gripper or rapier weaving machine, however, insertion can also be executed using projectiles or other insertion elements. The device 1 includes a clamping device 5, which, after weft insertion and cutting have been completed, clamps and holds the weft material 6 ready, in order to then present it again to the insertion element 4. The insertion element 4 takes the free end E of the weft material 6 from the device 1 at the device-side fabric edge 7 and moves it to the opposite fabric edge (not shown). Then, the inserted weft material 6 is cut off at the device-side fabric edge fabric so that once again, a new free end E is available for the next weft insertion.

It is provided that the clamping device 5 is conveyable between at least two different operating positions, as shown here by a dashed line. The movement of the clamping device in this regard is essentially in the direction of motion BR of the insertion element 4 and thus in the weft direction. A drive 8 is provided for conveying the clamping device 5.

According to the embodiment of a device shown in FIG. 1, the clamping device 5 is initially located in the transfer position (solid lines) and is conveyable from this position, essentially in the direction of motion of the insertion element, into a feed or delivery position (dashed lines). The weft material 6 is thus fed to the open clamp 10 of the insertion element 4 by a pivoting or swivel motion of the swivel unit 2 or of the clamping device 5. For this, the swivel unit includes a swivel arm 3, which is driven by the drive 8 and on which the clamping device 5 is arranged. Because only a small part of the circular motion is used to move the clamping device 5, the clamping device 5 moves largely in the weft direction so that there is no significant deflection of the weft material 6.

Figure 2:
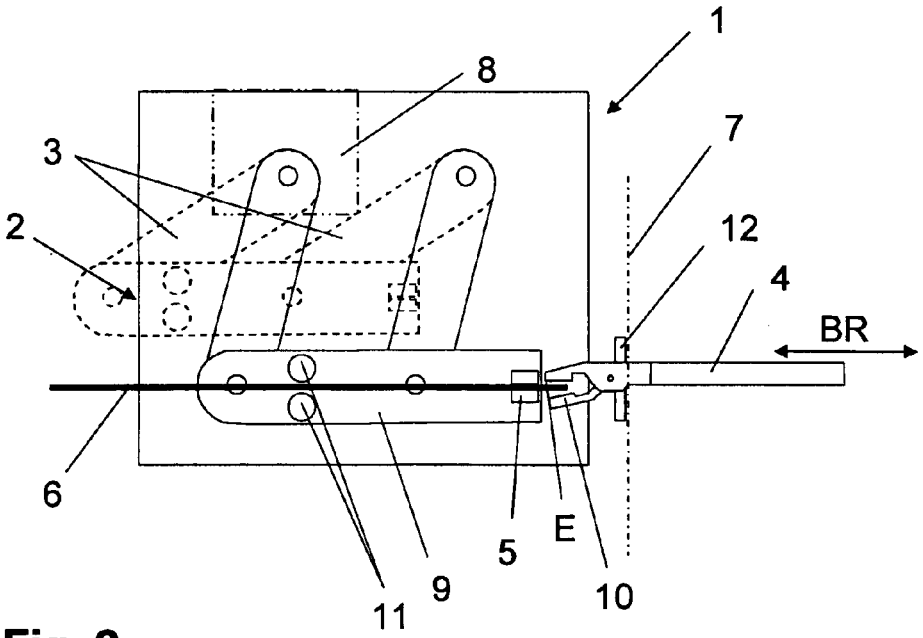

In a variation not shown here, the clamping device 5 can however also be arranged on a coupling element 9 similar to the one shown in FIG. 2. At one end thereof, the coupling element 9 is rotatably connected with the swivel arm 3, and at the other end thereof, it is linearly slidably supported in the device 1, so that the clamping device 5 itself is also moved purely linearly.

According to the illustrated embodiment of the invention, after weft insertion has been completed, the band-shaped weft material 6 is cut in the feed position (dashed illustration) and is then again moved into the transfer position (solid lines) by the swivel unit 2 swiveling or pivoting back.

FIG. 2 shows the inventive embodiment of the device, in which the swivel unit 2 comprises two parallel swivel arms 3 that are connected by a coupling element 9. In this regard, the clamping device 5 is arranged on the coupling element 9 and is again shown here in a transfer position (solid lines) for the weft material. In this regard, the insertion element 4 moves with the clamp 10 open toward the free end E being presented to it, so that the swivel unit 2 does not need to move into a feed position. To do this, the gripper might, if applicable, need to move farther sideways out of the shed. The clamping device 5 is conveyable from the depicted transfer position into a parked position (dashed lines) which is located outside of the line of motion of the insertion element 4. In this parked position, for example maintenance work such as spool exchanges can be performed by an operator. It is also possible to provide a second swivel unit 2' when the first swivel unit 2 is located in the parked position as will be described in further detail in FIG. 5. According to the present illustration, the weft material 6 is guided between two guide bolts 11 so that it constantly assumes a stretched and twist-free path or course.

The device 1 as well as the feed unit and, if applicable, additional handling equipment for the weft material 6 are preferably aligned flush with each other so that the weft material 6 runs or extends from the feed unit to the insertion element 4 essentially in a straight line without deflection elements or friction or rubbing points. The clamping device 5 is preferably embodied as a parallel gripper with two movable clamping jaws so that after the clamping device 5 has opened, there are no friction points for the weft band here, and a free weft insertion is possible. The clamping device 5 can, for example, be activated pneumatically, so that it can be activated independently of a drive 8 of the device 1 in a simple manner. Because no relative movement occurs between the weft material 6 and the device 1, the device 1 is also suitable for feeding or delivering sensitive materials with low slippage resistance as well as for fiber-reinforced bands. Damages to the weft material 6 can thus be avoided.

In the following, in connection with FIGS. 2 to 4, the functionality of the device 1 and the corresponding method for feeding or delivering the weft material 6 will be explained in more detail.

In the illustration shown in FIG. 2, the clamping device 5 is located in the transfer position (solid lines) for the insertion element 4, whereby the clamping device 5 is closed and presents the free end E of the weft material 6 to the insertion element 4. For the transfer, the insertion element 4 can now either move as described with the open clamp 10 toward the stationary free end E, or the clamping device 5 can feed the free end E in the direction of the insertion element 4 by means of a feed motion similarly as described in FIG. 1. After the transfer of the free end E into clamp 10 of the insertion element 4 has been completed, the clamp 10 is closed by a corresponding control means, for example a guide rail of the weaving machine. At the same time, the clamping device 5 is opened to allow an immediate subsequent weft insertion.

Figure 3:
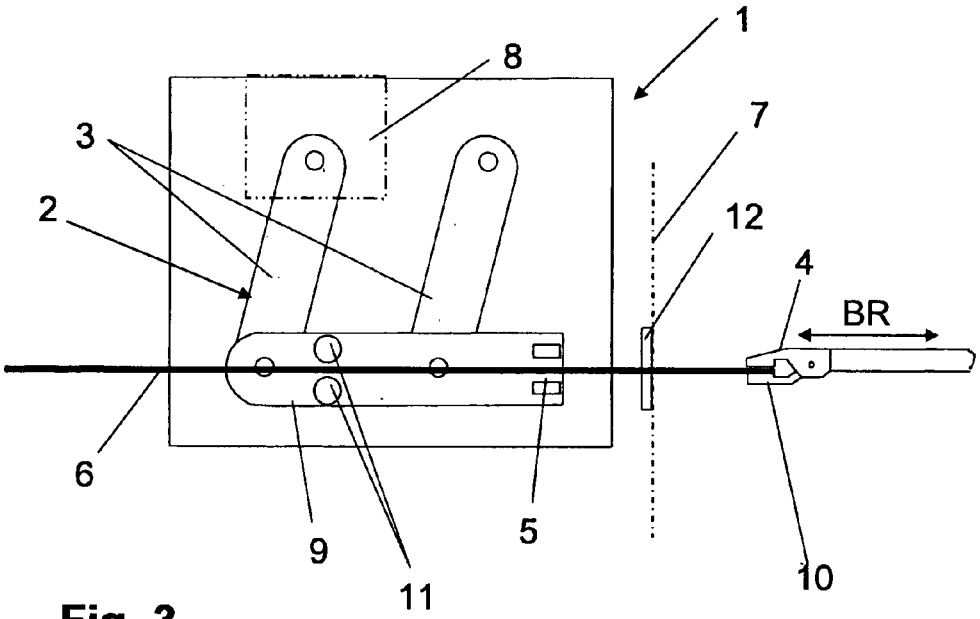

FIG. 3 shows the device 1, in which the clamping device 5 is still located in the transfer position, however, now it is open. Meanwhile, the insertion element 4 carries the weft material 6, which now runs freely between the feed unit and the clamping device 5, into the opened loom shed. If the weft material 6 is fed by a pre-spooling device or feeder, it is possible to put the weft material 6 under tension during the weft insertion so that no auxiliary brake is required for the weft material.

Figure 4:
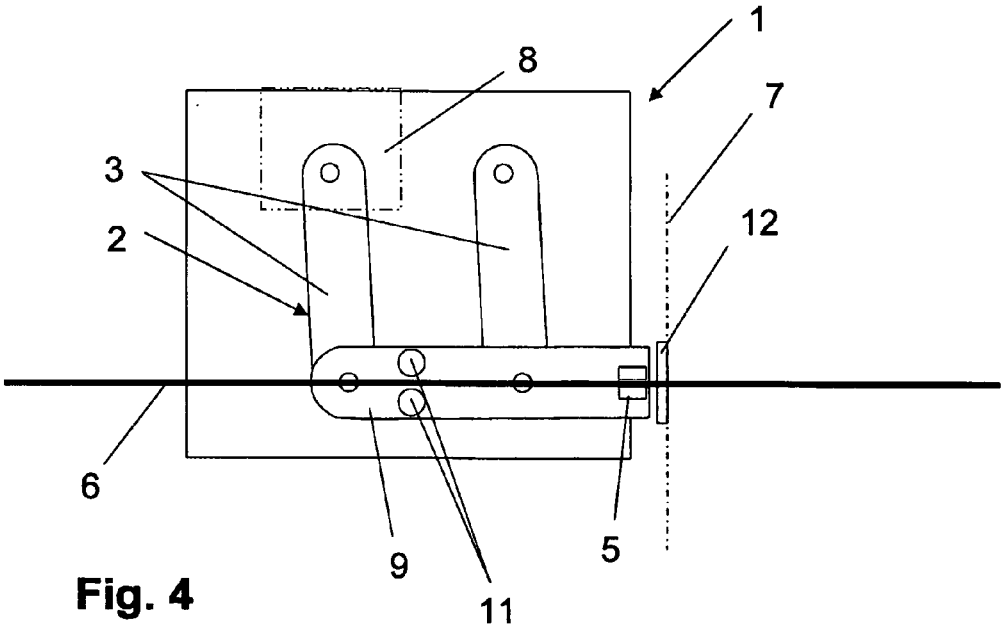

Parallel to the weft insertion by the insertion element 4, the opened clamping device 5 is moved out of the transfer position (FIG. 3) into a cutting position, which is illustrated in FIG. 4. The clamping device 5 is thus located close to the illustrated fabric edge 7. After the clamping device 5 has been moved into the cutting position by means of the swivel unit 2, the clamping device 5 is closed. Meanwhile, the insertion element 4 has arrived at the opposite fabric edge, but the clamp 10 is still closed. The weft material 6 is thus spanned between the clamping device 5 and the clamp 10 of the insertion element 4. In the cutting position shown in FIG. 4, the weft material 6 is finally cut near the fabric edge 7 by means of a cutting device 12. Preferably, hereby a tensile force is applied to the inserted weft material 6 during the cutting process. To this end, the drive 8 can be acted on by a corresponding torque opposite the feed or delivery direction.

It is especially advantageous if the cutting device 12 is formed by a rotating shear that is conveyable in the warp direction and which cooperates with a stationary counter-blade or anvil-blade. The band-shaped weft material 6 can thus be separated reliably and cleanly with a reduced risk of the weft material getting caught or jammed in the cutting device 12. To this end, the rotating shear comprises a rotatable round or curved blade and in the simplest case can be driven by the main drive of the weaving machine via a transmission. For this purpose, a spring-loaded cam disk or a complimentary cam disk can be provided, and a mechanical step-down or step-up transmission of power can be achieved via a multiple articulated gearbox.

It can be equally advantageous, however, to move the rotating shear in the warp direction using an independent electric motor drive, e.g. a servomotor, so that the cut can be made independently. Hereby, the rotating shear can be linearly slidably driven or driven slidably by a swivel or pivoting motion in the warp direction.

To bring the inserted weft material 6 into contact with the binding or interlacing point, a fabric formation can be executed by a movement of the fabric before the cutting. To this end, when the loom shed is closing, the fabric is moved in the direction of the stationary weft material 6 which is being kept under tension by the drive 8, so that the band-shaped weft material 6 is bound in. Hereby even band-shaped weft materials 6, which would be damaged by a conventional weft beat-up by means of a reed, can also be woven and still produce a tight woven fabric. After the binding of the weft material 6, the weft material 6 is then cut near the fabric edge 7 by means of the cutting device 12 as described above and the clamp 10 of the insertion element 4 is opened on the opposite side of the fabric.

In addition, a driven compaction roller can be provided below the fabric formation area, which roller touches the fabric from below and spreads the weft material 6 across the entire fabric width in the direction of the binding point. To this end, the compaction roller can be provided with cams or dogs that are adapted to the weave binding type and the lateral position of the warp threads or warp bands. This allows a very tight spacing of the weft bands in the woven fabric.

After the weft material 6 has finally been cut off near the fabric edge 7 in the cutting position shown in FIG. 4, the swivel unit 2 with the closed clamping device 5 is again moved to the transfer position shown in FIG. 2, to then once again present the end E of the weft material 6, which is now again lying free, to the insertion element 4 for the next weft insertion.

The drawing-off of the fabric is preferably achieved simply by a fabric roller or winder without a separate feeding or draw-in roll. The fabric thus runs over a deflecting roll, which deflects the fabric in the direction of the fabric roller or winder, and which at the same time is pivotably driven about a rotation or pivot point in order to execute the aforementioned fabric movement for the fabric formation. At the same time, the deflecting roll is embodied as a measuring roll to determine the current fabric speed. With the help of the fabric speed signal, the drive of the fabric roller or winder is ultimately regulated in such a manner so that a defined weft density arises.

The location of the feed position as well as of the cutting position of the clamping device 5 are preferably freely adjustable so that the weft material 6 can reliably be fed to the insertion element 4 in every operating state of the weaving machine, and on the other hand, so that as little weft material as possible is brought to the opposite side of the fabric as waste. It is thus especially advantageous if, during or after the weft insertion, the swivel unit 2 with the clamping device 5 moves in the direction of the fabric edge 7 into the cutting position as described in FIG. 4 and clamps the weft material 6 as close as possible to its free end E. The protruding free end E is thus very short so that it can just barely be gripped by the clamp 10 of the insertion element 4 after the clamping device 5 has returned to the transfer position. The weft material 6 that is brought to the opposite side of the fabric as waste can hereby be minimized. It is also advantageous if the location of the transfer position or, if applicable, of the feed position is freely adjustable, because while the weaving machine is being adjusted at a creeping speed the conditions are always different from when it is operating at the operational rotation speed. If the drive 8 of the device 1 is formed by an independent drive 8 such as, for example, a servomotor, then the clamping device 5 can be conveyed from the transfer position to the feed position as well as the cutting position in any desired manner. Especially when only a single weft material 6 is being fed, as shown in FIGS. 2 to 4, it is however similarly possible to realize the aforementioned movement sequences via a suitable transmission from the main drive of the weaving machine.

Figure 5:
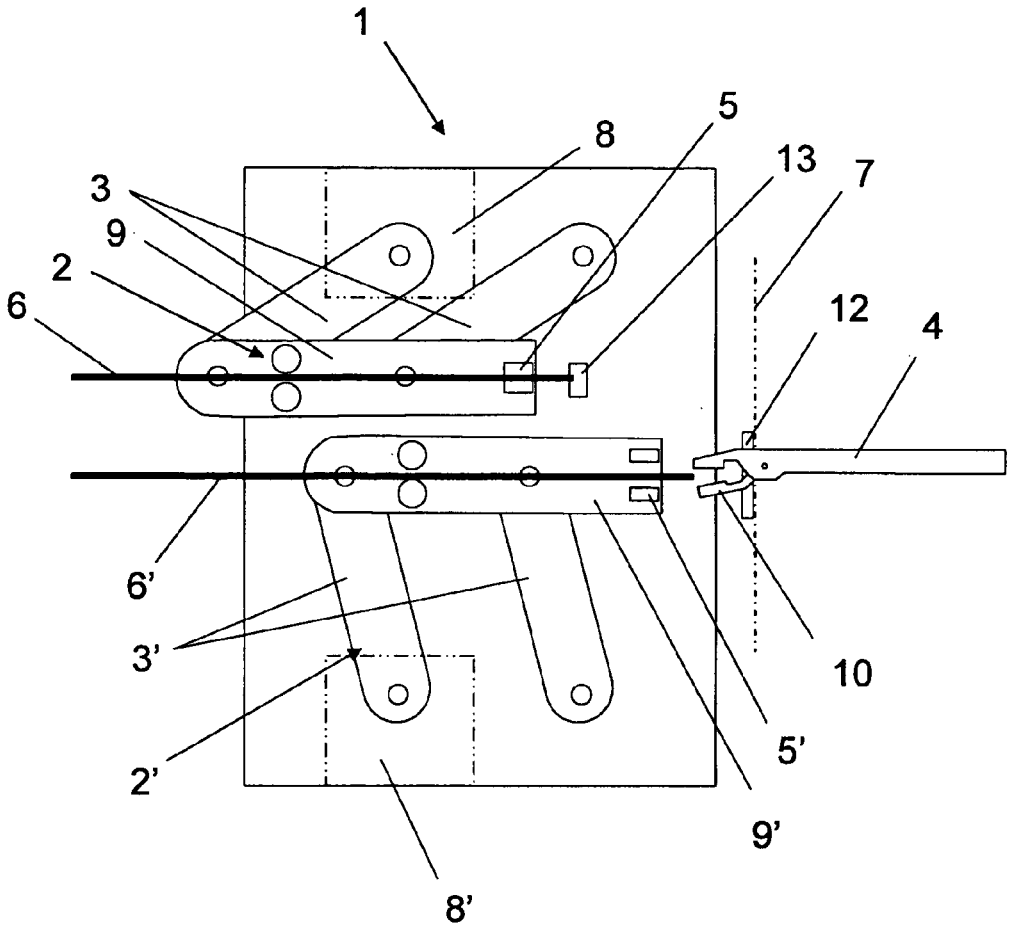

FIG. 5 shows another embodiment of the invention in which the device 1 includes a second swivel unit 2', by means of which a second weft material 6' can be fed to the insertion element 4. This makes it possible to feed two different weft materials by means of the device 1 and thereby produce the most varied weave patterns in the woven fabric. Because the feed packages comprise a comparatively short running length for band-shaped materials 6, thus nonetheless a package or bobbin exchange can take place during running machine operation by means of the device 1 shown in FIG. 5. In the illustration shown, the swivel unit 2' with the clamping device 5' is located in the transfer position and is available for the insertion, while the swivel unit 2 with the clamping device 5 with the clamped weft material 6 is located in a parked position. The weft material 6 is also present in a parked position, and during the process it is substantially twist-free and deflection-free and essentially in a stretched state, so that damage to the weft material 6 need not be a concern.

FIG. 5 shows the transfer of the weft material 6 corresponding to the illustration of FIG. 2, wherein the insertion element 4 with the clamping device 5 opened, moves toward the free end E. However, similarly as described in FIG. 1, the free end E can also be fed by means of a swivel motion of the swivel unit 2 into a feed position in the already opened clamp 10 of the insertion element 4. After the weft insertion is completed, which is executed as described above (see FIGS. 2 to 4), after the weft material 6' is cut, the swivel unit 2', with the closed clamping device 5', is conveyed from the cutting position into its parked position as shown by the dashed line so that subsequently, the swivel unit 2 with the closed clamping device 5 and clamped weft material 6 can be is conveyed into the transfer position in order to execute an exchange of the weft material 6, 6'.

Alternatively, the device in FIG. 5 can be used to allow for a package or bobbin exchange during the operation of the weaving machine. When doing so, it must be ensured that no adhesive joining or splicing spot remains within the weave. In this regard, the exhaustion or running-out of a spool or bobbin can be determined either by a sensor that is mounted at a suitable location on the weaving machine in the area of the feed unit or the device 1, or a spool or bobbin exchange can always take place after a specified number of wefts. To change from the first weft material 6 to the second weft material 6' after the first weft material 6 has run out, the first swivel device 2 with the clamping device 5 is conveyed into its parked position and the second swivel device 2' with the clamping device 5' is brought into the transfer position in order to feed the second weft material 6'. Corresponding to the band-length required for a complete weft insertion, the weft material 6 can then be cut off by an operator at a precisely defined position in the area of the is feed unit (in the present illustration, to the left of the device 1). The operator replaces the empty bobbin with a full bobbin and connects the weft material 6 of the new, full bobbin to the end of the weft band that has run out and is still located in the device 1, for example by adhesive bonding. During that, is the weaving machine continues to run, wherein the weft material 6' is fed by the second swivel unit 2'. After completion of the bobbin exchange on the first swivel unit 2, this swivel unit can then again be released for the weft insertion. In this regard, it is especially advantageous that the weaving machine does not have to be stopped for the bobbin exchange, so that no faults or defects can occur in the woven fabric due to start-up marks. If the cutting position is precisely maintained, adhesive joint or splice spots in the woven fabric can also be avoided, because these are located in the area of the fabric edge in connection with exact cutting by an operator.

In order to completely avoid adhesive joint or splice spots both in the woven fabric as well as in the edge area, however, even after switching over to the second supply package or swivel unit 2', both the almost empty bobbin with the first weft material 6 as well as the remnant piece of the weft material 6 still located in the device 1 can be removed. After a full bobbin has been mounted, the weft material 6 of the new bobbin is threaded through the guide bolts 11 and the clamping device 5 into the device 1, during which the clamping device 5 can be manually actuated by corresponding operating buttons or keys. In order to make the free end E of the weft material 6 available to the insertion element 4 with the exact length, the position of the front end of the weft material 6 can be monitored by a sensor 13, for instance a light barrier, as it is being threaded into the device 1. Closing the clamping device 5 is not done manually in this case, but instead when the correct position of the free end E is reached. This kind of sensor 13 can be arranged on the device 1, for example, near the clamping device 5 in the parked position as illustrated in FIG. 5. After the clamping device 5 closes, the weft material 6 or the swivel device 2 can be released again for the weft insertion.

It is, however, also possible to stop the weaving machine for the bobbin exchange. In this regard, after stopping the weaving machine, the bobbin exchange is carried out as described above, in that the almost empty spool as well as the weft material 6 still located in the device 1 are completely removed and the beginning of the new weft material 6 is threaded into the device 1 as described. After threading and closing the clamping device 5, the weaving machine can then be restarted. This process is thus also suitable for a device 1, by means of which only one single weft material is feedable. In this regard, it is especially advantageous that no adhesive joint or splice spots arise in the woven fabric.

Figure 6:
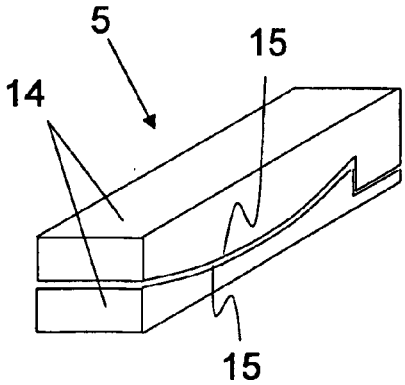

FIG. 6 shows a perspective illustration of the clamping device 5 in an embodiment as a parallel gripper. For this, the clamping device 5 comprises two movable clamping jaws 14, which, as already described, allow for a free weft insertion without deflection or friction points for the weft material 6. According to the depicted illustration, in the area of the clamping surfaces 15 the clamping jaws 14 comprise a semi-circular cross-section or a cross-section that is otherwise curved in the direction of the width of the weft material, so that the band-shaped weft material 6 is stiffened by the corresponding deformation when the clamping device 5 is closed. The free protruding end E of the weft material 6 can thus also be surely or reliably fed to the insertion element 4 even if the weft material 6 only has a small inherent rigidity or stiffness. According to the illustration of FIG. 6, the clamping jaws 14 of the clamping device 5 are embodied essentially parallelepiped-shaped. It is also possible, however, to adapt the shape of the clamping jaws 14 to the shape of the insertion element 4, in order to be able to guide the clamping device 5 closer to the insertion element 4 and allow for the activation of the clamp 10 by a control rail. Thus the clamping jaws can, for example, be slanted in order to be adapted to fit a warp-deflecting shape of the gripper head.

The invention is not limited to the illustrated example embodiments. Derivations and combinations of the various different features in the scope of the patent claims are also encompassed by the invention.

REFERENCE CHARACTER LIST

1 Device for transferring a weft material
2 Swivel unit
3 Swivel arm
4 Insertion element
5 Clamping device
6 Weft material
7 Fabric edge
8 Drive
9 Coupling element
10 Clamp
11 Guide bolt
12 Cutting device
13 Sensor
14 Clamping jaws
15 Clamping surfaces
E Free end of the weft material
BR Direction of motion of the insertion element

The invention claimed is:

1. A device (1) for transferring a preferably band-shaped weft material (6) from a feed unit to an insertion element (4) of a weaving machine with a clamping device (5) for clamping a free end (E) of the weft material (6), wherein the clamping device (5) is conveyable essentially in a direction of motion of the insertion element (4) between at least two different operating positions, and the device (1) includes a drive (8) for conveying the clamping device (5), wherein the clamping device (5) is conveyable by a swivel unit (2), which includes at least one swivel arm (3) and which is drivable by the drive (8), characterized in that the swivel unit (2) includes two parallel swivel arms (3), which are connected by a coupling element (9), wherein the clamping device (5) is arranged on the coupling element (9).

2. The device according to claim 1, characterized in that the clamping device (5) is conveyable between a transfer position in a line of motion of the insertion element (4) and a parked position outside of the line of motion of the insertion element (4).

3. The device according to claim 2, characterized in that the clamping device (5) is conveyable from the transfer position in the line of motion of the insertion element (4) into a feed position in the line of motion of the insertion element (4).

4. The device according to claim 3, characterized in that a location of the feed position is freely adjustable.

5. The device according to claim 3, characterized in that the clamping device (5) is conveyable from the transfer position or the feed position into a cutting position in the line of motion of the insertion element (6).

6. The device according to claim 5, characterized in that a location of the cutting position is freely adjustable.

7. The device according to claim 2, characterized in that, for feeding a second weft material (6'), the device (1) further includes a second swivel unit (2') with a second clamping device (5'), and the clamping devices (5, 5') are selectively conveyable between respective individual parked positions thereof and a shared common transfer position.

8. The device according to claim 7, characterized in that the clamping device (5) is conveyable from the transfer position in the line of motion of the insertion element (4) into a feed position in the line of motion of the insertion element (4).

9. The device according to claim 1, characterized in that the drive (8) comprises an independent electric motor drive.

10. The device according to claim 9, characterized in that in order to apply a tension force to the weft material (6), the swivel unit (2) with the clamping device (5) is reversibly drivable.

11. The device according to claim 1, characterized in that the clamping device (5) is pneumatically actuatable.

12. The device according to claim 1, characterized in that the clamping device (5) comprises a parallel gripper with two movable clamping jaws (14).

13. The device according to claim 12, characterized in that the movable clamping jaws (14), in an area of clamping surfaces (15) thereof, comprise a cross-section that is curved in a direction of a width of the weft material.

14. The device according to claim 1, characterized in that a shape of the clamping device (5) is adapted to a shape of the insertion element (4).

15. The device according to claim 1, characterized in that the device further includes a sensor (13) arranged and adapted to detect a presence of the weft material (6) and/or a position of the free end (E) of the weft material (6).

16. The device according to claim 1, characterized in that the device (1) further includes guide elements, preferably guide bolts (11), for the weft material (6).

17. A weaving machine including said device for feeding a preferably band-shaped weft material (6) according to claim 1.

18. The weaving machine according to claim 17, characterized in that the weaving machine further includes a rotating shear, which is conveyable in a warp direction, as a cutting device (12) for the weft material (6).

19. The weaving machine according to claim 18, characterized in that the cutting device (12) comprises a stationary counter-blade or anvil-blade.

20. The weaving machine according to claim 18, characterized in that the rotating shear is conveyable in the warp direction by a main drive of the weaving machine via a cam disk transmission.

21. The weaving machine according to claim 18, characterized in that the rotating shear is conveyable by an independent electric motor drive.

22. A method of transferring a band-shaped weft material from a feed unit to an insertion element of a weaving machine, comprising the steps:

a) clamping the weft material adjacent to a free end thereof in a clamping device that is connected to and drivable by a drive so that the clamping device is movable essentially in a direction of motion of the insertion element;

b) engaging the free end of the weft material with the insertion element;

c) opening the clamping device to release the weft material;

d) inserting the weft material into a loom shed by moving the insertion element in the direction of motion of the insertion element;

e) after the step d), closing the clamping device to clamp the inserted weft material at a new clamping location on the weft material; and f) after the step e), activating the drive to move the clamping device so as to apply a tension force onto the inserted weft material.

23. The method according to claim 22, wherein the clamping in the step a) is carried out with the clamping device in a transfer position, and wherein between the steps a) and b) the method further comprises activating the drive to move the clamping device from the transfer position to a feed position at which the steps b) and c) are carried out.

24. The method according to claim 22, further comprising, after the step e), bringing the inserted weft material into contact with a fabric binding point, during which the tension force is applied onto the inserted weft material in the step f).

25. The method according to claim 22, further comprising, during or after the inserting of the weft material in the step d) activating the drive to move the clamping device into a cutting position, and after the step d) cutting off the inserted weft material.

26. The method according to claim 25, comprising performing the cutting after the closing of the clamping device in the step e) and during the applying of the tension force in the step f).

27. The method according to claim 22, further comprising, after the step f) while maintaining the tension force, cutting off the inserted weft material adjacent to the new clamping location.

28. The method according to claim 22, further comprising, after the step f), activating the drive to move the clamping device in a direction laterally away from the direction of motion of the insertion element to a first parked position displaced laterally away from a line of motion of the insertion element.

29. The method according to claim 28, wherein the abovementioned clamping device is a first clamping device and the abovementioned drive is a first drive, and further comprising:

after the step f) while maintaining the tension force, cutting off the inserted weft material adjacent to the new clamping location, and thereafter performing the moving of the first clamping device to the first parked position;

clamping a next weft material adjacent to a free end thereof in a second clamping device that is connected to and drivable by a second drive;

activating the second drive to move the second clamping device from a second parked position thereof, which is displaced laterally away from the line of motion of the insertion element, to a shared common transfer position, which lies on the line of motion of the insertion element and which had been taken up by the first clamping device in the steps b) and c);

engaging the free end of the next weft material with the insertion element; and opening the second clamping device to release the next weft material.

30. The method according to claim 22, further comprising, during the step d), running the weft material essentially freely without obstruction between the feed unit and the insertion element.

31. The method according to claim 22, further comprising, during the steps a) and b), holding the weft material in the clamping device in such a manner or configuration so as to stiffen the free end of the weft material.

32. The method according to claim 22, further comprising, using a sensor, sensing at least one of a presence of the weft material and a position of the free end of the weft material.

33. The method according to claim 32, further comprising closing the clamping device to initiate the step a) when the sensor senses that the free end of the weft material has reached a predefined position.

* * * * *